US005978965A

United States Patent [19]

Summers

[11] Patent Number: 5,978,965

[45] **Date of Patent: *Nov. 9, 1999**

[54] UPPER BODY GARMENT

[76] Inventor: Neil Summers, Beechwood House, King Georges Hill, Abinger Bottom, Dorking, Surrey RH5 6JW, United Kingdom

[ * ] Notice: This patent is subject to a terminal disclaimer.

[21] Appl. No.: 09/128,719

[22] Filed: Aug. 4, 1998

Related U.S. Application Data

[63] Continuation-in-part of application No. 08/805,174, Feb. 26, 1997, Pat. No. 5,806,093.

[51] Int. Cl.[6] ..... A41B 1/00

[52] U.S. Cl. ..... 2/69; 2/115; 601/134

[58] Field of Search ..... 2/69, 115, 337, 2/227, 231, 455, 456, 44, 92, 94, 83, 85, 108, 267, 255, 258, 243.1, 113, 114; 601/76, 84, 85, 88, 134, 136, 138, 148, 149, 151; 606/201, 204

[56] References Cited

U.S. PATENT DOCUMENTS

| | | | |
|---|---|---|---|
| 2,152,734 | 4/1939 | Ford . | |
| 2,620,862 | 12/1952 | Hite . | |
| 3,145,054 | 8/1964 | Sopko, Jr. . | |
| 3,713,696 | 1/1973 | Dudley . | |
| 4,189,182 | 2/1980 | Rhoe . | |
| 4,210,134 | 7/1980 | Okazaki et al. . | |
| 4,383,342 | 5/1983 | Forster . | |
| 4,529,248 | 7/1985 | Trotman et al. . | |
| 4,572,578 | 2/1986 | Perkins . | |
| 4,744,351 | 5/1988 | Grundei et al. . | |
| 5,086,519 | 2/1992 | Rokasky | 2/408 |
| 5,297,293 | 3/1994 | Obujen | 2/267 X |
| 5,328,245 | 7/1994 | Marks et al. . | |
| 5,381,558 | 1/1995 | Lo | 2/115 |
| 5,571,076 | 11/1996 | Cooper | 2/44 X |
| 5,806,093 | 9/1998 | Summers | 2/69 |

FOREIGN PATENT DOCUMENTS

| | | |
|---|---|---|
| 0 036 158 | of 1981 | European Pat. Off. . |
| 2.206.074 | of 1974 | France . |
| 2 391 718 | of 1978 | France . |
| 2634-119 | of 1990 | France . |
| 36 44 196 A1 | of 1988 | Germany . |
| 93 03 800 U | of 1993 | Germany . |
| 59-133225 | of 1984 | Japan . |
| 61-24021 | of 1986 | Japan . |
| 63-22911 | of 1988 | Japan . |
| 63-40994 | of 1988 | Japan . |
| 63-50331 | of 1988 | Japan . |
| 7-268705 | of 1995 | Japan . |

*Primary Examiner*—Gloria Hale
*Attorney, Agent, or Firm*—Baker & Daniels

[57] ABSTRACT

An upper body garment which is provided with strips of muscle relaxing pads arranged to face areas of the body in which muscle tension is likely to be a problem. The muscle relaxing pads are in the form of arrays of resilient nodules which extend inwardly to face the muscles of a wearer. The pads are placed sequentially along a strip which is inserted into a pocket in the garment. The strip is formed to present a convex curved profile to the wearer of the garment, thereby enhancing the therapeutic benefits of the garment.

21 Claims, 5 Drawing Sheets

UPPER BODY GARMENT

CROSS REFERENCE TO RELATED APPLICATIONS

This is a continuation-in-part of application Ser. No. 08/805,174 filed Feb. 26, 1997, now Pat. No. 5,806,093.

BACKGROUND OF THE INVENTION

1. Field of the Invention

The present invention relates to an upper body garment, and in particular, to one which can relax the muscles of the garment wearer.

2. Description of Related Art

Back problems result in millions of working days lost every year and cause untold misery to around sixty percent (60%) of all people at some time in their lives. For many people, back pain is caused by poor posture while walking or standing, working at desks, or sitting in front of the television. Other causes of back pain are old or inadequate beds or mattresses, and strenuous jobs which cause tension in the back.

Living with crippling back pain is often a vicious circle. That is, when a person is having back pain, that person automatically tenses his or her muscles, which reinforces bad posture and muscle spasms, and in turn causes even more pain. Doctors, physiotherapists, osteopaths, and chiropractors have been attempting for decades to solve the problem of back pain.

One proven invention uses two known methods to relieve back pain. The first method is massage, the second is stretching. U.S. Pat. No. 5,722,102, owned by the inventor of the present application, which is hereby incorporated by reference, discloses a back rest device having a supporting surface presenting two elongate continuous or discontinuous protuberances which extend along side one another and are arranged to engage the back of a person. In use, a person rests against the supporting surface which has a channel between the protuberances to accommodate the bony part of the spine with substantially no pressure on the bony part of the spine. The surfaces 12 of the knobbles 9 disclosed by U.S. Pat. No. 5,722,102 are positioned to give the user the equivalent of a deep "shiatsu" massage. That is, they are designed to loosen the soft tissue of the muscles in the back and restore normal muscle tone. In addition to providing massage, the back stretcher disclosed in U.S. Pat. No. 5,722,102 is shaped such that a person can effortlessly lie across it and allow their spine to open out gradually. In this manner the disks that have probably been pressed against each other all day are freed, thereby removing pressure from any damaged joints and promoting stimulus in order for the body to stay strong and healthy. Thus, stretching the back is accomplished by the two rows of knobbles slowly decompressing the intervertebral joints with the aid of gravity for general traction.

It is also known to install massaging devices inside garments. U.S. Pat. No. 5,381,558 discloses a device for massaging a body part, e.g., the back, which comprises a plurality of protuberances of various shapes that are attached securely to the inside of a garment. Theoretically, when a person wearing the massage garment disclosed by U.S. Pat. No. 5,381,558 sits on a chair, a bed or a couch, the body of the person presses against the protuberances and the protuberances thereby stimulate the circulatory system making muscles or joints supple so as to relieve pain and tension. However, such a device as disclosed by U.S. Pat. No. 5,381,558 involves each massage pad comprising only a single protuberance. Such an arrangement could be quite uncomfortable for a wearer because the weight of the wearer would be borne at relatively few localized spots. Such a device does not utilize the proven methods of massage and stretching as does U.S. Pat. No. 5,722,102 to Summers, as discussed above.

SUMMARY OF THE INVENTION

The present invention is an upper body garment provided with muscle relaxing pads which massage and stretch the back of the wearer.

In one form, the present invention is an upper body garment comprising muscle relaxing pads each of which further comprises an array of nodules of resilient material. The nodules extend inwardly from the garment. Preferably, the pads are positioned sequentially along at least one strip, which is removably retained in the garment.

In another form, the present invention is an upper body garment comprising a pocket extending down a back side of the garment. The pocket has an opening on its top end so that a strip can be removably retained in the pocket. The strip has an array of nodules of resilient material extending inwardly from the garment. In a preferred form, there are two pockets arranged to be positioned on each side of the spine of the wearer. A strip fits into each of the two pockets. A wearer of the garment can then lean against a backrest of a chair or lie face-up on the floor, thereby deriving the therapeutic muscle relaxation and stretching from the garment.

In a preferred form of the above described invention, the strip is comprised of a flexible material having the nodules extending on a front side of the strip and having a back side which can be positioned in a substantially linear orientation along a longitudinal axis of the strip. In other words, the strip is flexible and can be arranged in a straight line up and down orientation. When the back side is positioned in this straight line orientation, the nodules extend a maximum inward distance at an intermediate location along the strip. The inward distance the nodules extend then decreases in both longitudinal directions along the strip away from the intermediate location. In this manner, the strip presents a convex curve to the wearer which compliments the natural shape of the back. Such a convex curve enhances the massaging and especially the stretching effect of the present invention.

One advantage of the present invention is that when the garment is worn, the wearer can readily relax a muscle simply by pressing the appropriately positioned pad against the adjacent muscle, thereby allowing the resilient nodules to massage the muscle. In particular, the advantageous arrangement of the present invention allows the back to be massaged simply by the wearer sitting back in a chair or lying face up on the floor, whereby the resilient nodules of the pads in the garment of the present invention massage the muscle.

Another advantage of the present invention is the convex shaped curve formed by the strips, or columns, of pads. For instance, when a user wears the garment of the present invention and lies against a substantially flat surface, the columns form a convex shaped curve which has its highest point at a location intermediate the upper and lower ends of the column. Such a convex shaped curve complements the natural shape of the back and provides greater muscle massage and relaxation for the wearer.

Yet another advantage of the present invention is that the strips are removably retained in the garment. Such an arrangement allows the strips to be easily removed from the garment when the garment is being washed, for example. Furthermore, such an arrangement allows interchangeability of the strips with more than one garment and saves money as a result.

Yet another advantage of the present invention is that it provides improved massaging action by presenting one or more profiles which are convex in two directions. Such convex profiles present one or more humps to the body of the wearer which massage the body in a way similar to pads of thumbs during a shiatsu massage. In above described preferable arrangement, at least some of the pads have at least two inwardly facing profiles, or humps, on one or more pads. Having two or more humps on a pad mimics the action of two thumb pads during a conventional massage.

Another advantage of the present invention is that its curved profile encourages good posture in the seated position and provides stretching when used in the lying position. When in the seated position, the wearer can merely press his or her back against the seat back and, provided the seat back is substantially flat, the curved shape of the strip of the present invention will encourage good posture.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
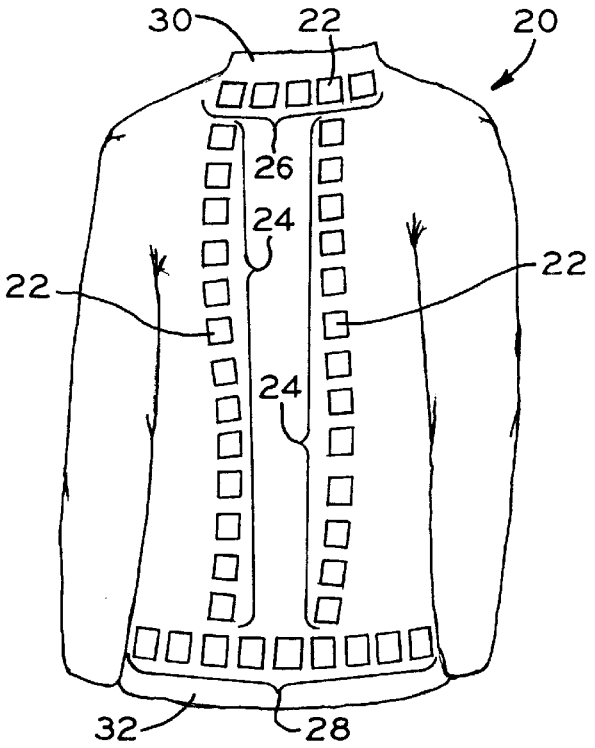
FIG. 1 is a view showing the arrangement of muscle relaxing pads on a garment according to the present invention.

Corresponding reference characters indicate corresponding parts throughout the several views although the drawings represent embodiments of the present invention the drawings are not necessarily to scale and certain features can be exaggerated in order to better illustrate and explain the present invention. The exemplification set out herein illustrates an embodiment of the invention, in one form, and such exemplification is not to be construed as limiting the scope of the invention in any manner.

DETAILED DESCRIPTION OF THE INVENTION

FIG. 1 shows garment 20 of the present invention having pads 22. The pads 22 can be arranged as shown in FIG. 1 in strips or columns 24, 26 and 28. Columns 24 extend down garment 20 from neck area 30 to lower back area 32. Column or strip 26 extends across neck area 30. Column 28 extends across lower back area 32. Columns 24, 26 and 28 are conveniently arranged to massage the back, neck and lower back areas of the user, respectively. While columns 24, 26 and 28 are arranged as shown in FIG. 1, it is to be understood that such columns can be arranged in any manner which is designed to provide muscle massage and relaxation of the wearer of garment 20 and be within the scope and spirit of the present invention.

Figure 2:
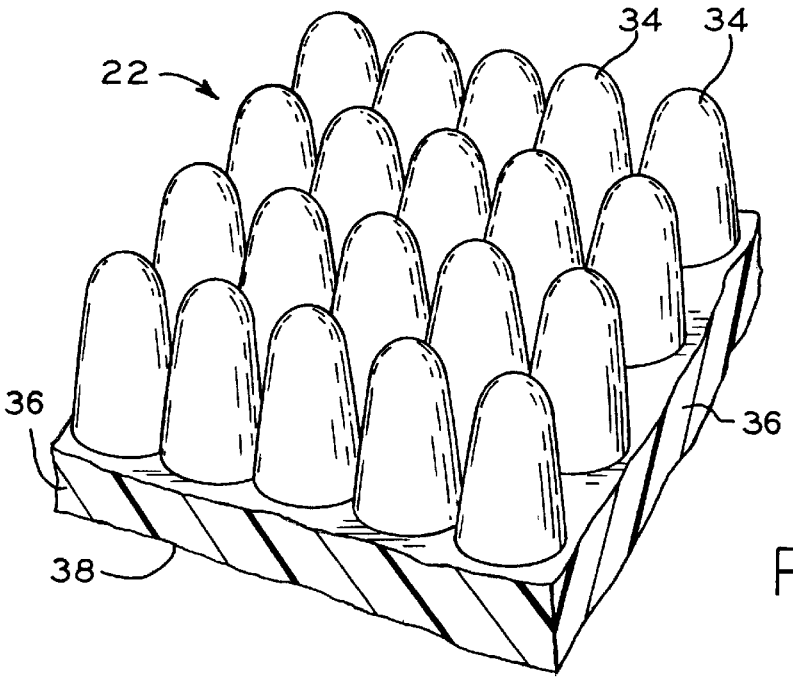
FIG. 2 is a perspective view of a portion of a pad.
Figure 3:
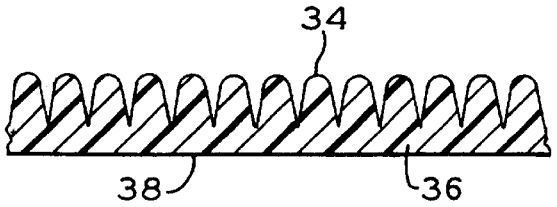
FIG. 3 is a cross-section through a pad.

As shown in FIGS. 2 and 3, pads 22 are comprised of smaller nodules 34 and base portion 36. Nodules 34 extend away from base portion 36 as shown in FIGS. 2 and 3 and are spaced relatively closely together to form an array. Pads 22 also include on their back side planar surface 38 which is substantially flat as shown in FIGS. 2 and 3.

Pads 22 are arranged in garment 20 so that nodules 34 face inwardly. That is, when the pads 22 are installed in garment 20, the nodules face in a direction to press against a body surface of the wearer of garment 20. Pads 22 can be formed as discrete pads so that each pad 22 is individually installed within garment 20. Alternatively, as discussed in detail below, pads 22 can be formed as a continuous strip wherein base portion 36 connects each array of nodules 34.

Figure 6:
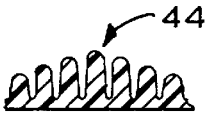
FIG. 6 is a cross section of FIG. 4D taken in a direction orthogonal to the cross section of FIG. 5.

The benefits of pads 22 within garment 20 can be better appreciated with reference to one exemplary arrangement of pads as shown in FIGS. 4–6. The pads shown in FIGS. 4A through 4G are arranged in two strips, or columns 40. Columns 40 have a top end starting with the pads shown in FIG. 4A and extend downwardly to a bottom end with the pads shown in FIG. 4G. In use, the two columns 40 are positioned on each side of the spine of the wearer. The upper most pads shown in FIG. 4A are the largest in the sense that they are wider than the lower pads, such as shown in FIG. 4G, with the width of the pads diminishing progressively down the garment.

As shown in FIGS. 5A–5G, the height of the nodules varies so that the envelope of the tips of the nodules of each pad provides a surface which is convex in the horizontal direction as can be seen in FIGS. 5A–5G and in the vertical direction as can be seen in FIG. 6. The pads toward the upper part of the garment are shaped such that the profile provides a pair of convex humps 42 which mimic the action of a pair of thumb pads during normal massage. The profile of the pads, particularly towards the lower part of the garment, have a single convex hump 44 which mimics the action of a single thumb pad.

Figure 4A:
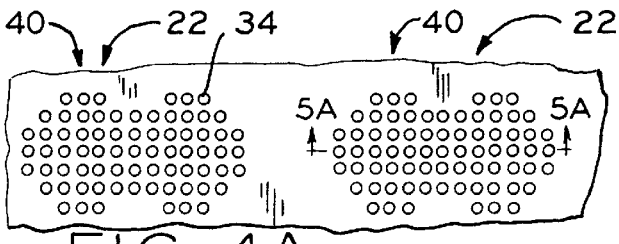
FIG. 4 is a plan view of an exemplary arrangement of pads extending down the back of the garment of the present invention.
Figure 4B:
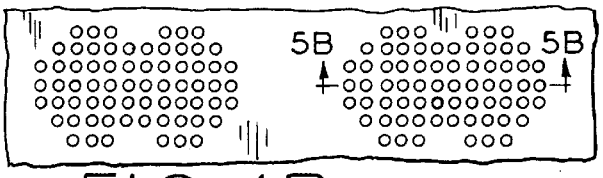
Figure 4C:
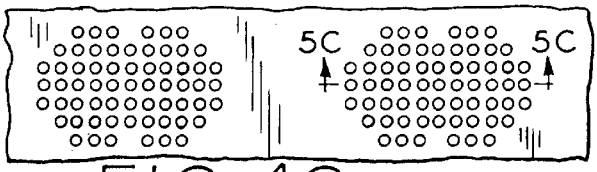
Figure 4D:
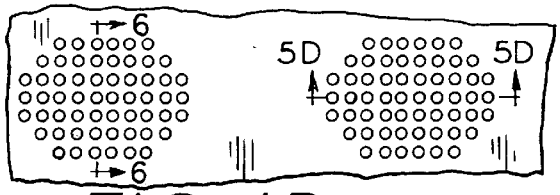
Figure 4E:
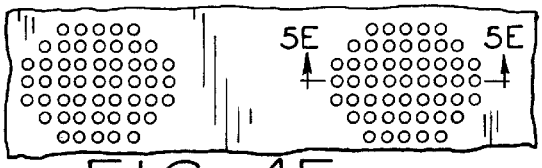
Figure 4F:
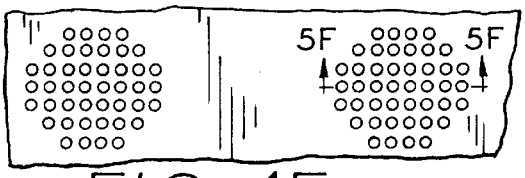
Figure 4G:
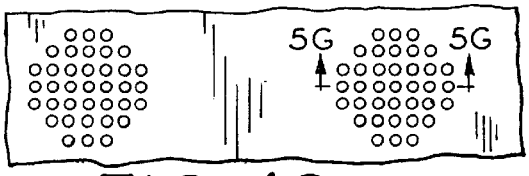
Figure 5A:
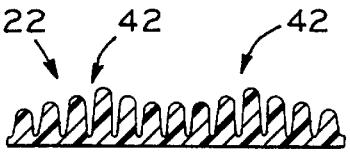
FIG. 5 is a series of cross sections of the respective pads as shown in FIG. 4.
Figure 5B:
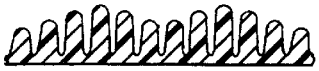
Figure 5C:
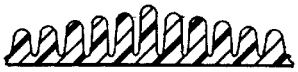
Figure 5D:
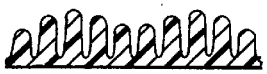
Figure 5E:
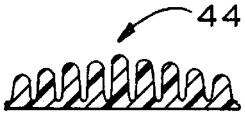
Figure 5F:
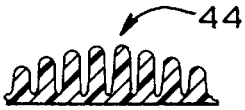
Figure 5G:
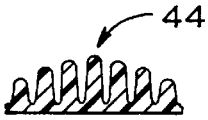

Nodules 34 on pads 22 as shown in FIG. 4A can be fused to a fabric such as brushed cotton (not shown). One or both of the vertical columns 40 may be provided on a single fabric strip, and each strip can be sewn into the garment with the pads extending down each side of the center line of the back of the garment.

Figure 7:
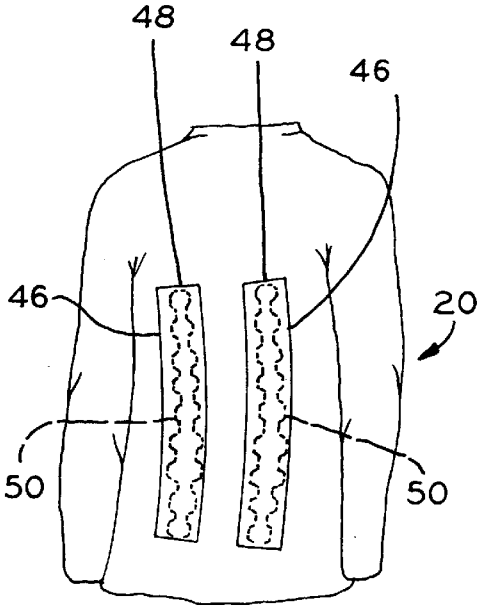
FIG. 7 is a perspective view of the pads of the present invention arranged in strips inserted in a garment of the present invention.

Another embodiment of garment 20 of the present invention is shown in FIGS. 7–10 and 12–15. With reference to FIG. 7, garment 20 includes pockets 46 which have openings 48 at a top end thereof. Pockets 46 can be sewn to the inside of garment 20 by any suitable means well known in the art.

Figure 9:
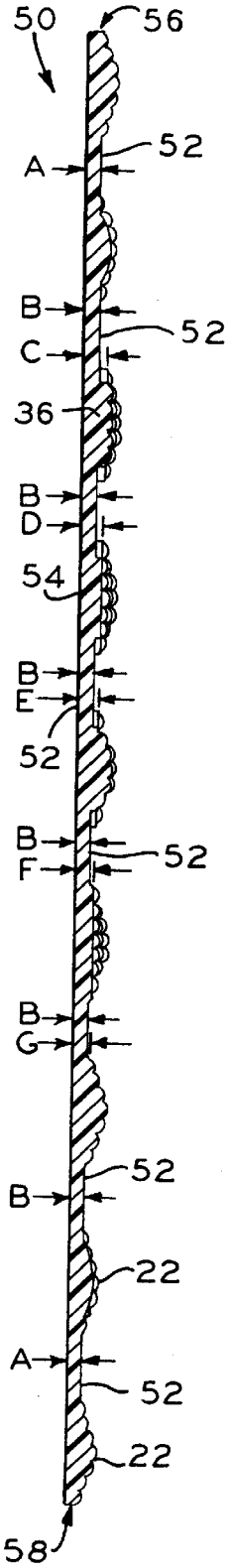
FIG. 9 is a side elevational view corresponding to the strip of FIG. 8.
Figure 8:
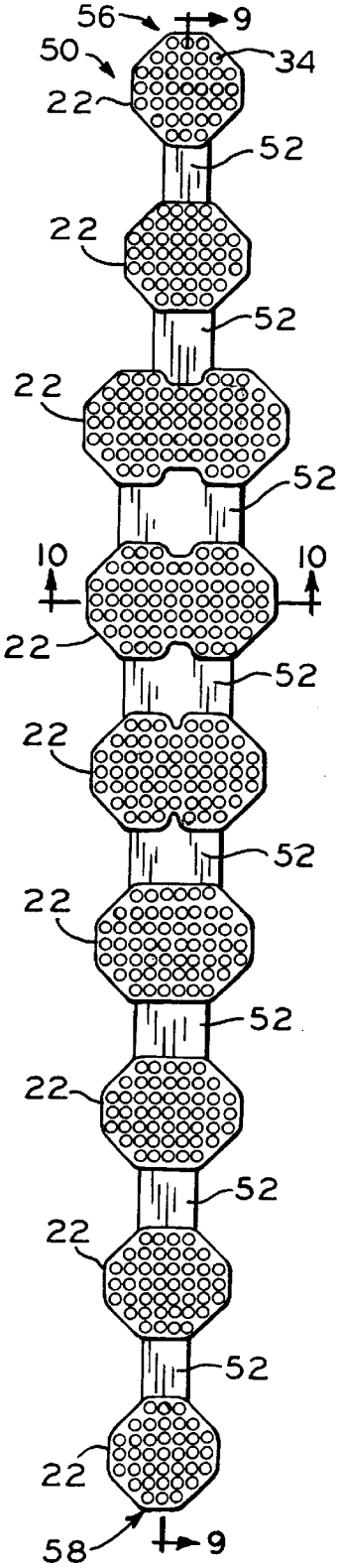
FIG. 8 is a top plan view of a strip containing pads according to one form of the present invention.
Figure 10:
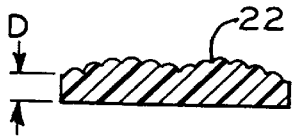
FIG. 10 is a cross sectional view taken along line 10—10 of FIG. 8.

As mentioned above, pads 22 can be provided on a continuous strip or column, such as strip 50 shown in FIGS. 8 and 9. Strip 50 can conveniently be placed into pockets 46 as shown in FIG. 7. Similar to the embodiment shown in FIGS. 4–6, the height of the nodules shown in FIGS. 8 and 9 varies so that the envelope of the tips of the nodules of each pad provides a surface which is convex in two directions. The convex profile in the horizontal direction is shown in FIG. 10.

Strip 50 can be formed as a continuous piece of a single material, the composition of which can be one of any variety of materials. For example, it has been found that strip 50 can be formed from foam strips of PE15-Polyolefin. However, other plastics or rubbers would be suitable for strip 50. Furthermore, strip 50 need not be made from a continuous piece of a single material. For example, connecting portions 52, which are shown in FIGS. 8 and 9 as connecting pads 22 together on strip 50, could be comprised of a first material whereas pads 22 could be comprised of a second material. It is desirable that strip 50 be somewhat flexible so that when strip 50 is inserted into pocket 48 and garment 20 is worn by a user, strip 50 can move and adapt with the movement of the user.

While strip 50 is flexible, back planar surface 38 of each of the pads 22 can be arranged so that the entire back surface 54 of strip 50 is substantially planar, or linear along the longitudinal axis of strip 50. That is to say, back surface 54 can be arranged in a substantially linear or planar arrangement as shown in FIG. 9.

With further reference to FIG. 9, it will be understood that pads 22 on strip 50 can be optionally arranged so that strip 50 forms a curve which complements the shape of the back so that the massage and muscle relaxation effects are enhanced. When back surface 54 is arranged in a planar orientation as shown in FIG. 9, some of the pads 22 extend further from back surface 54 than others. As shown in FIG. 9, beginning from the top portion 56 of strip 50 the width (or vertical height) of connecting portions 52 increases traversing down strip 50, remains constant for most of the intermediate portion of strip 50, and then decreases again at the bottom 58 of strip 50. For example, dimension A can be approximately 4.5 mm whereas dimension B can be approximately 5 mm.

Similarly, the height of base portion 36 increases traversing from the top portion 56 of strip 50, reaches a maximum value, and then decreases again toward the bottom portion 58 of strip 50. In the embodiment shown in FIG. 9, for example, dimension C is 8 mm and represents the maximum height of base portion 36. Proceeding further down strip 50, dimension D is 7 mm, dimension E is 6.5 mm, dimension F is 6.0 mm and dimension G is 5.5 mm. The effect of varying the dimensions as described above produces a curve for strip 50 which further enhances the therapeutic effects of strip 50. While specific dimensions are recited for this exemplary embodiment, it is to be understood that the dimensions could vary substantially from those disclosed herein and still remain within the scope of the present invention.

Figure 11:
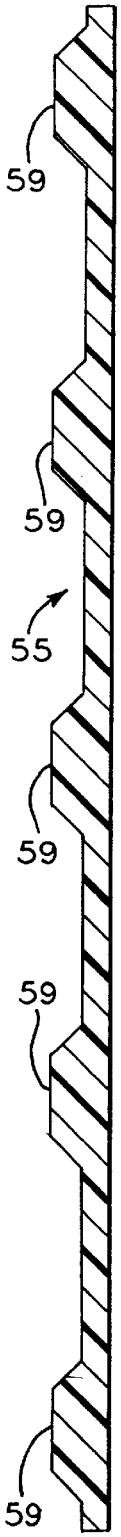
FIG. 11 is a sectional view of a strip of pads according to the present invention.
Figure 12:
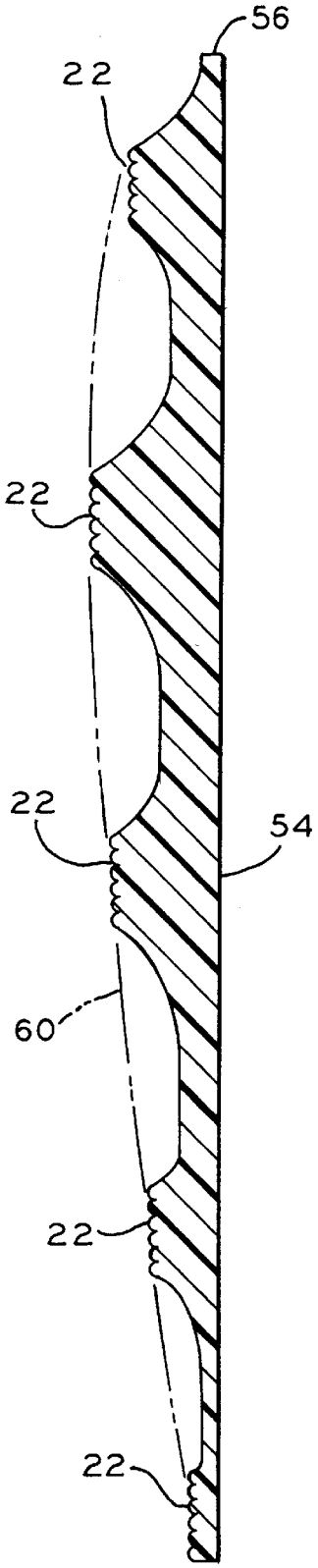
FIG. 12 is a sectional view of a strip of pads illustrating the optional curved profile according to the present invention.

The posture correcting benefits of the optional curved shape of the present invention can be better appreciated with reference to FIGS. 11 and 12. As shown in FIG. 11, pads 59 can be arranged along a column so that they all extend the same distance from back surface 55. Such a garment is useful when only massage is desired. By contrast, FIG. 12 illustrates the optional curved shape of the profile of strip 50. As can be seen in FIG. 12, when back surface 54 is arranged in a substantially planar orientation, pads 22 extend a varying distance from back surface 54 as one traverses from top end 56 to bottom end 58 of strip 50. The net effect is to produce a convex curve 60 which has a high point at an intermediate location toward the top end 56 of strip 50 and decreases in both directions away from the high point along strip 50.

Figure 13:
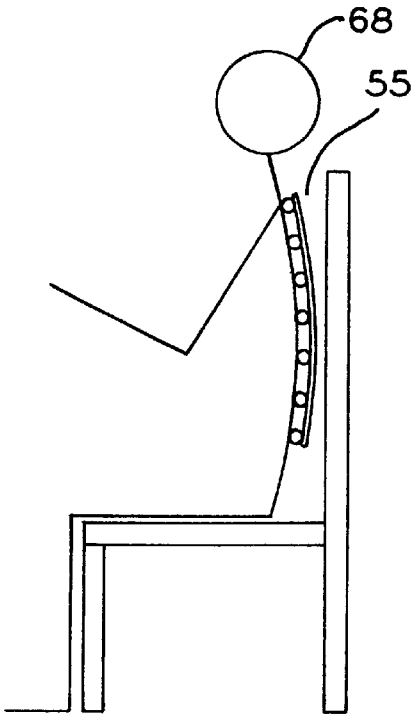
FIG. 13 is a diagrammatic view of a wearer of an upper body garment without any posture correcting features.
Figure 14:
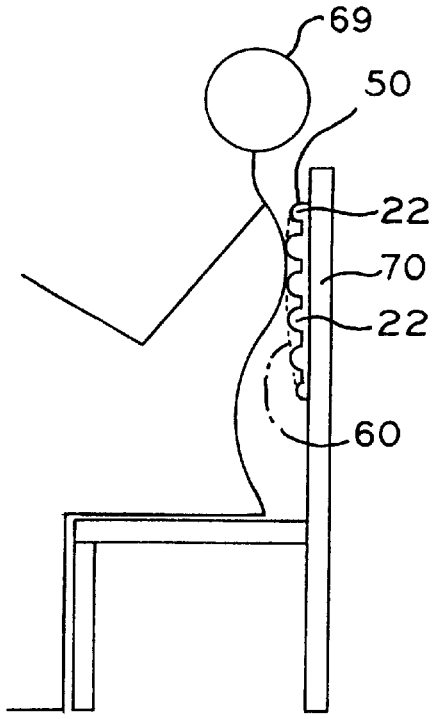
FIG. 14 is a diagrammatic view of a wearer of an upper body garment including the posture enhancing features in accordance with the present invention.

FIG. 13 illustrates a garment lacking the optional curved profile of the present invention. While the garment shown in FIG. 13 provides muscle massage, the wearer 68 is shown sitting in a somewhat "slumped" position, exhibiting generally poor posture. Such a posture causes back pain and can lead to further complications. By contrast, FIG. 14 illustrates a garment of the present invention wherein the wearer 69 is gaining the benefit of the convex curved profile 60. When in the seated position, wearer 69 can merely press his or her back against the seat back 70 and, provided the seat back is substantially flat as shown in FIG. 14, the curved shape 60 of strip 50 will encourage good posture. Further, curved profile 60 stretches the back when used by a wearer when lying on a flat, firm surface, such as a floor.

Figure 15:
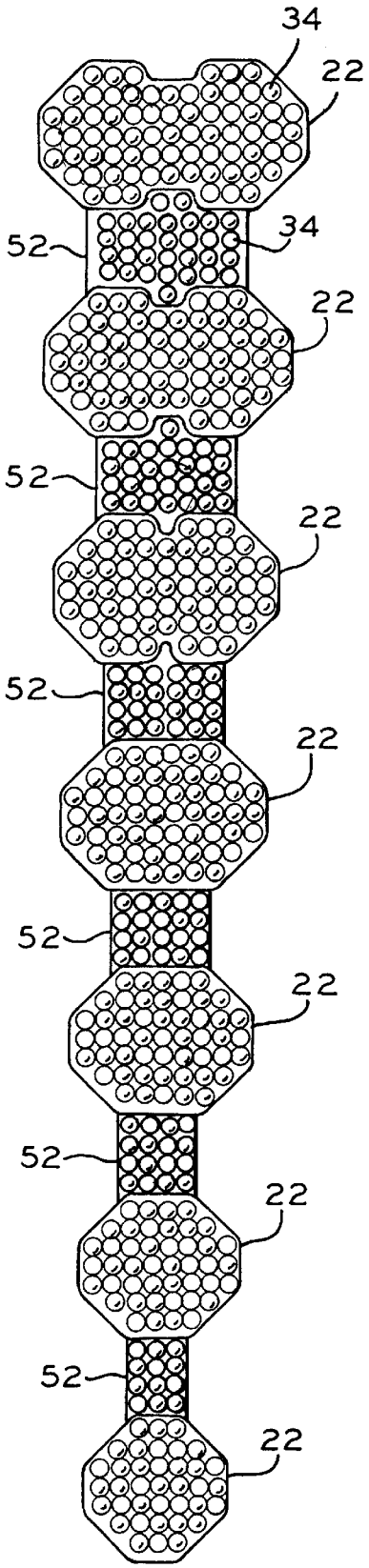
FIG. 15 is a top plan view of a strip of an alternate embodiment of the present invention.

FIG. 15 illustrates another embodiment of the present invention wherein nodules 34 are included on both pads 22 and connecting portions 52. Such an arrangement can further enhance the relaxation and massage benefits of the present invention.

While this invention has been described as having a preferred design, the present invention can be further modified within the spirit and scope of this disclosure. This application is therefore intended to cover any variations, uses or adaptations of the invention using its general principles. Further, this application is intended to cover such departures from the present disclosure as come within known or customary practice in the art to which this invention pertains and which fall within the limits of the appended claims.

What is claimed is:

1. An upper body garment comprising:

a plurality of muscle relaxing pads disposed on the inside of said garment, each said pad further comprising an array of nodules of resilient material, said nodules extending inwardly from said garment;

said pads located sequentially along at least one strip, and said at least one strip being removably retained in said garment.

2. The garment of claim 1, wherein said pads are arranged in a spaced-apart arrangement along a longitudinal axis of said strip.

3. The garment of claim 2, wherein for each said pad, said nodules are a plurality of inwardly facing projections that define an envelope presenting at least one inwardly facing profile which is convex in two directions.

4. The garment of claim 1, wherein for at least one of said pads, said nodules are inwardly facing projections that define an envelope presenting a plurality of inwardly facing profiles which are convex in two directions.

5. The garment of claim 1, further comprising a pocket which has an opening at one end thereof, said strip fitting within said pocket.

6. The garment of claim 1, wherein:

said strip includes a back surface which faces in a substantially opposite direction than said nodules, said strip being flexible and said back surface capable of assuming a substantially planar orientation; and wherein when said back surface is arranged in said substantially planar orientation, said nodules on each of said pads extend a respective distance away from said back surface; and said distance is a maximum for an intermediate one of said pads and said distance decreases sequentially with each respective pad in either direction away from said pad having said maximum distance.

7. The garment of claim 6, wherein said pads form a convex profile.

8. An upper body garment comprising:

a pocket extending down a back side of said garment, said pocket having an opening on one end thereof, a strip removably retained in said pocket; and said strip having an array of pads of resilient material extending inwardly from said garment.

9. The garment of claim 8, comprising a pair of said pockets and including a second said strip, each said strip fitting into a respective one of said pockets, said pair of pockets arranged to be positioned on each side of the spine of a wearer.

10. The garment of claim 8, wherein said pads each define an envelope presenting at least one inwardly facing profile which is convex at least one direction.

11. The garment of claim 8, wherein said strip is flexible and comprises a front side having said pads extending therefrom and a back side which can be positioned in a substantially linear orientation along a longitudinal axis of said strip, and wherein when said back side is positioned in said substantially linear orientation, said pads extend a maximum inward distance at an intermediate location along said strip, said distance decreasing in both longitudinal directions along said strip away from said intermediate location.

12. The garment of claim 8, wherein said pads comprise an array of nodules of resilient material extending inwardly from said garment.

13. The garment of claim 12, wherein said pads are positioned spaced apart on said strip and are connected together along said strip by a series of connecting portions.

14. The garment of claim 13, wherein at least one of said connecting portions includes nodules extending inwardly therefrom.

15. An upper body garment provided in selected areas with muscle relaxing pads, each said pad having a front surface comprising an array of nodules which extend inwardly from said garment, said pads disposed successively along at least two columns extending down said garment and adapted to be positioned on either side of the spine of the wearer, each said pad having a back surface, wherein:

when each said back surface is positioned substantially along a common plane, said nodules on each said pad extend a distance from said plane, whereby said distance is a maximum for an intermediate one of said pads in a respective column and said distance decreases with each pad positioned successively away from said intermediate pad.

16. The garment of claim 15, wherein said columns form a convex shaped curve and said intermediate pad in each column coincides with a highest point on said curve.

17. The garment of claim 15, wherein said nodules of one of said pads define an envelope presenting at least one inwardly facing profile which is convex in two directions.

18. The garment of claim 17, wherein said nodules of one of said pads form an envelope presenting at least two inwardly facing profiles, each of which is convex in two directions.

19. The garment of claim 18, wherein said two directions are orthogonal to each other.

20. An upper body garment provided in selected areas with muscle relaxing pads, each pad comprising an array of nodules of resilient material, said nodules extending inwardly from said garment, said pads being provided in the form of at least one strip of spaced apart pads, each said strip being retained in the garment in a pocket which is open towards the top of the garment to allow said strip of pads to be slid in and out.

21. The upper body garment of claim 20 wherein two pockets are provided which extend down each of the parts of the garment which are arranged to be positioned on either side of the spine of the wearer and wherein each pocket accommodates a respective strip of said pads.

* * * * *